United States Patent [19]

Slaughter, Jr.

[11] Patent Number: 4,582,149

[45] **Date of Patent: * Apr. 15, 1986**

[54] DRILL BIT HAVING REPLACEABLE NOZZLES DIRECTING DRILLING FLUID AT A PREDETERMINED ANGLE

[75] Inventor: Robert H. Slaughter, Jr., Houston, Tex.

[73] Assignee: Reed Rock Bit Company, Houston, Tex.

[ * ] Notice: The portion of the term of this patent subsequent to May 14, 2002 has been disclaimed.

[21] Appl. No.: 547,183

[22] Filed: Oct. 31, 1983

Related U.S. Application Data

[63] Continuation-in-part of Ser. No. 241,909, Mar. 9, 1981, abandoned.

[51] Int. Cl.[4] ..... E21B 10/18

[52] U.S. Cl. ..... 175/340; 175/422 R; 239/600

[58] Field of Search ..... 175/340, 339, 422, 393, 175/331; 239/589, 600

[56] References Cited

U.S. PATENT DOCUMENTS

| | | | |
|---|---|---|---|
| 1,143,273 | 6/1915 | Hughes | 175/339 |
| 1,784,476 | 12/1930 | Zublin et al. | 175/340 |
| 1,922,436 | 8/1933 | Herrington | 175/340 |
| 2,098,758 | 11/1937 | Reed | 175/340 |
| 2,815,936 | 12/1957 | Peter et al. | 175/340 |
| 3,129,777 | 4/1964 | Haspert | 175/393 |
| 3,220,754 | 11/1965 | Mori | 175/340 |
| 3,273,805 | 9/1966 | Hall | 239/600 X |
| 3,823,789 | 7/1974 | Garner | 175/422 |
| 4,219,161 | 8/1980 | Freissle | 239/600 X |
| 4,222,447 | 9/1980 | Cholet | 175/340 |
| 4,301,877 | 11/1981 | Cloud | 175/340 |
| 4,516,642 | 5/1985 | Childers et al. | 175/340 |

FOREIGN PATENT DOCUMENTS

| | | | |
|---|---|---|---|
| 2802868 | 8/1978 | Fed. Rep. of Germany | 175/339 |
| 836317 | 6/1960 | United Kingdom | 175/393 |
| 1104310 | 2/1968 | United Kingdom | 175/340 |

*Primary Examiner*—James A. Leppink
*Assistant Examiner*—Hoang C. Dang
*Attorney, Agent, or Firm*—Carl A. Rowold

[57] ABSTRACT

A nozzle system for a rotary drill bit comprising a plurality of elongate nozzle members detachably secured in drilling fluid exit bores in a drill bit body, each nozzle member having passaging therein, the lower portion of which is angled relative to the longitudinal axis of the nozzle member, and a projection and recess arrangement for holding each nozzle member in its bore in a predetermined angular position for directing the drilling fluid to flow in a stream along a line at a predetermined angle and in a predetermined position relative to an adjacent roller cutter of the drill bit for improved cleaning of the cutting elements and the formation.

6 Claims, 8 Drawing Figures

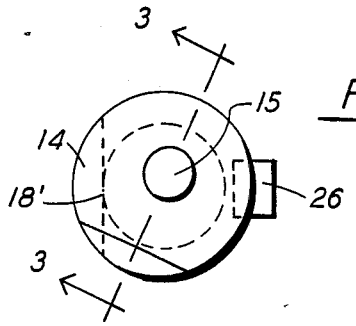
FIG. 6
FIG. 4
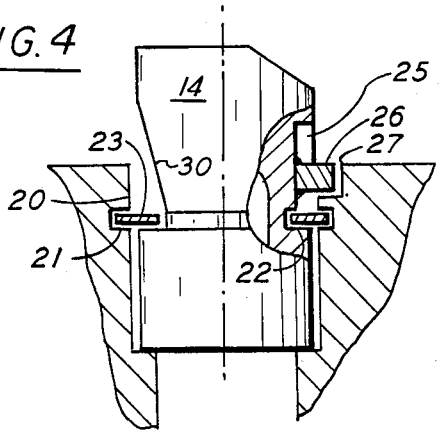
FIG. 5
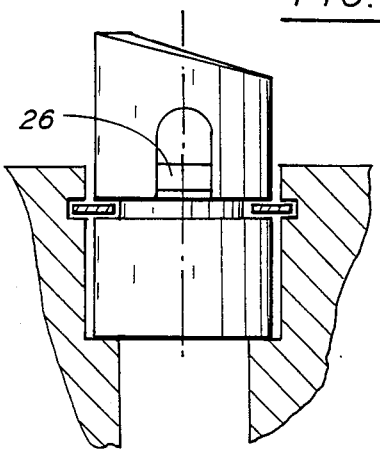
FIG. 3
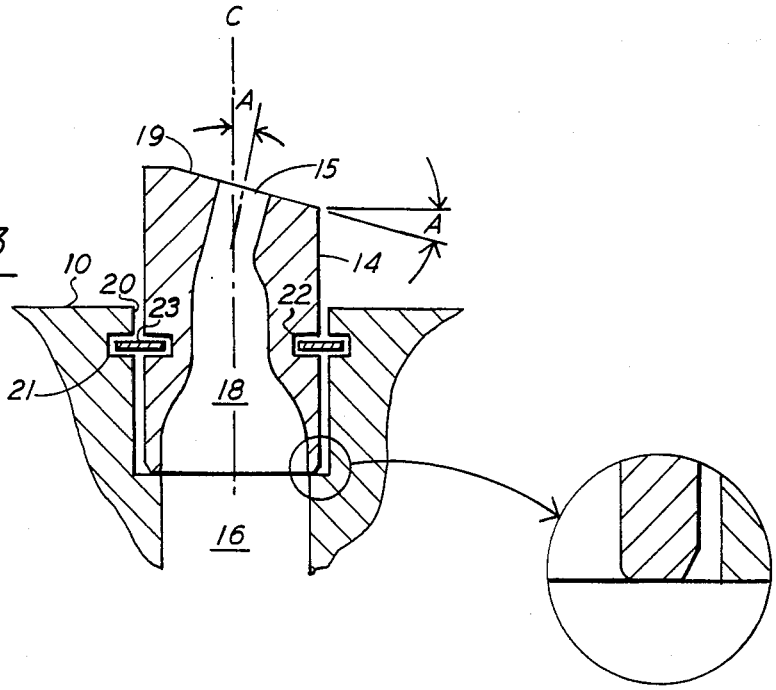

FIG. 8
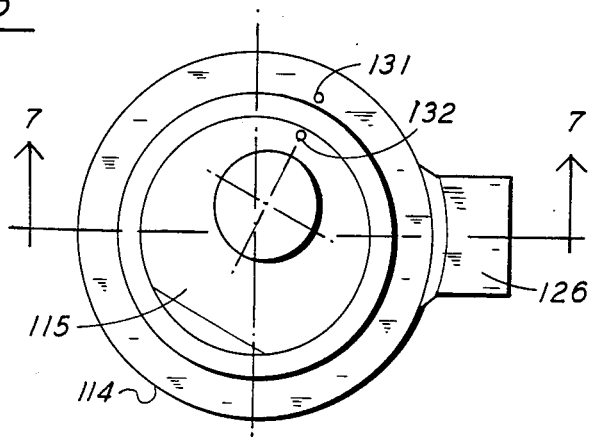
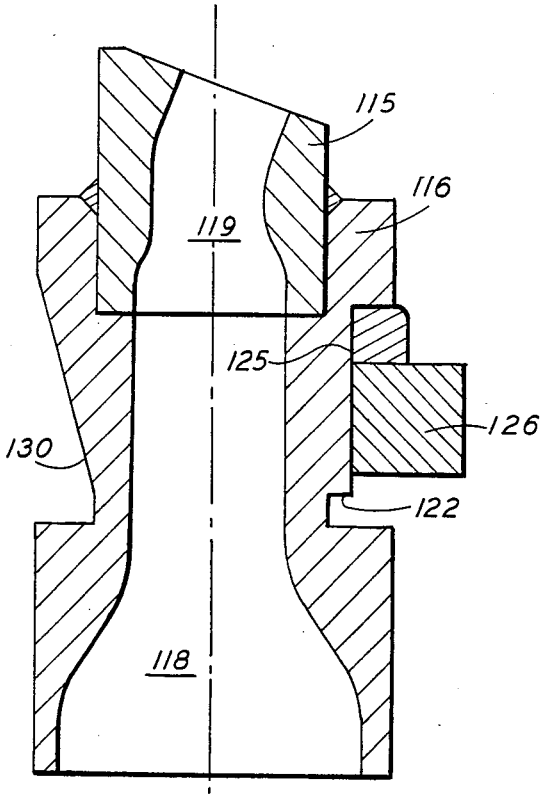
FIG. 7

DRILL BIT HAVING REPLACEABLE NOZZLES DIRECTING DRILLING FLUID AT A PREDETERMINED ANGLE

CROSS-REFERENCE TO OTHER APPLICATIONS

This is a continuation-in-part of U.S. patent application Ser. No. 241,909, filed Mar. 9, 1981, for Mounting Means for Drill Bit Directed Nozzles "now abandoned".

BACKGROUND OF THE INVENTION

The present invention generally relates to rolling cutter drill bits and more specifically involves a nozzle mounting system for a jet-type rolling cutter drill bit. In conventional drilling bits, having the jet nozzle structure, the nozzles generally are formed separately and attach to the drill bodies by means such as braising, set screws, and pressing in. The present invention discloses an extended nozzle system for use in a rolling cutter drill bit which nozzle system may be a single integrally formed nozzle member or may comprise multiple segment nozzles of two or more different alloys. A means is disclosed for detachably securing the nozzle quickly and efficiently to the drill body and additional means is disclosed for alignment of the nozzle in the body in a predetermined angular position.

In the pending application to J. S. Childers, et al., CIP, Ser. No. 553,937 filed Nov. 21, 1983, entitled "Rolling Cutter Drill Bit", a drill bit having extended directed nozzles was disclosed which is particularly advantageous for use in high overbalance and plastic formations. The present invention is particularly useful in the drilling bit disclosed in said Childers, et al. application in its entirely is incorporated herein by reference.

BRIEF DESCRIPTION OF THE DRAWINGS

FIG. 3 is a cross-sectional illustration of one embodiment of the nozzle system.

FIGS. 4, 5 and 6 are different views of the nozzle system of FIG. 3.

FIGS. 7 and 8 are illustrations of a second embodiment of the nozzle system of the present invention.

DESCRIPTION OF THE PREFERRED EMBODIMENTS

Figure 1:
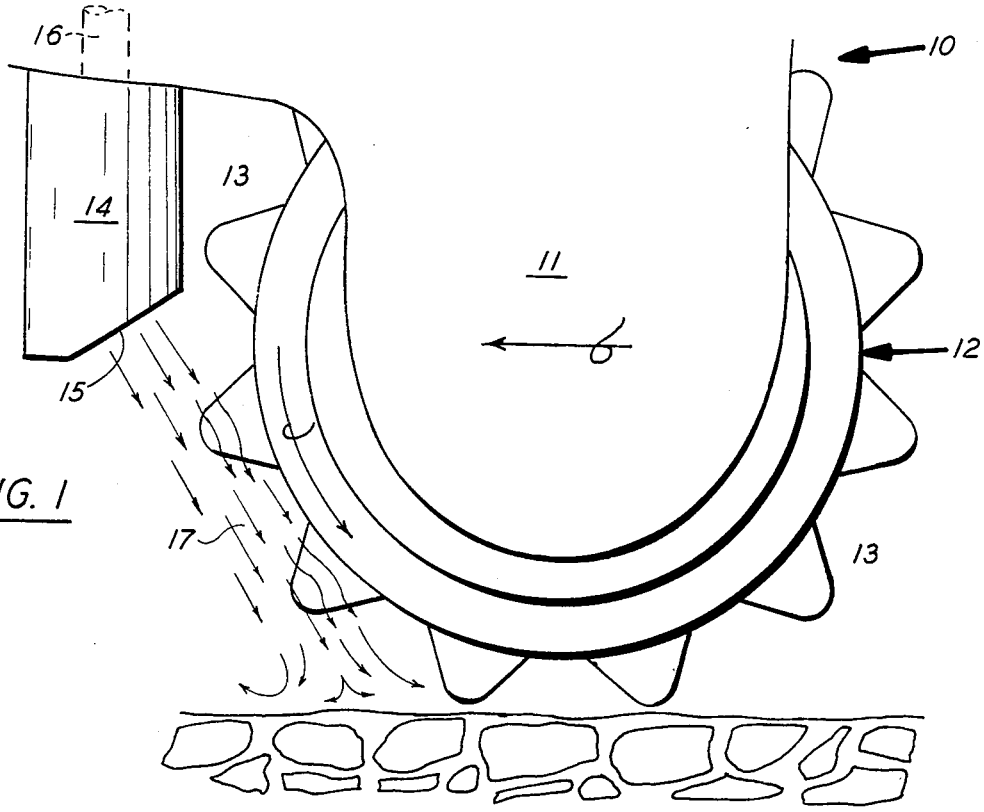
FIG. 1 is a partial schematic side view of a rolling cutter drill bit having one directed nozzle system of this invention.
Figure 2:
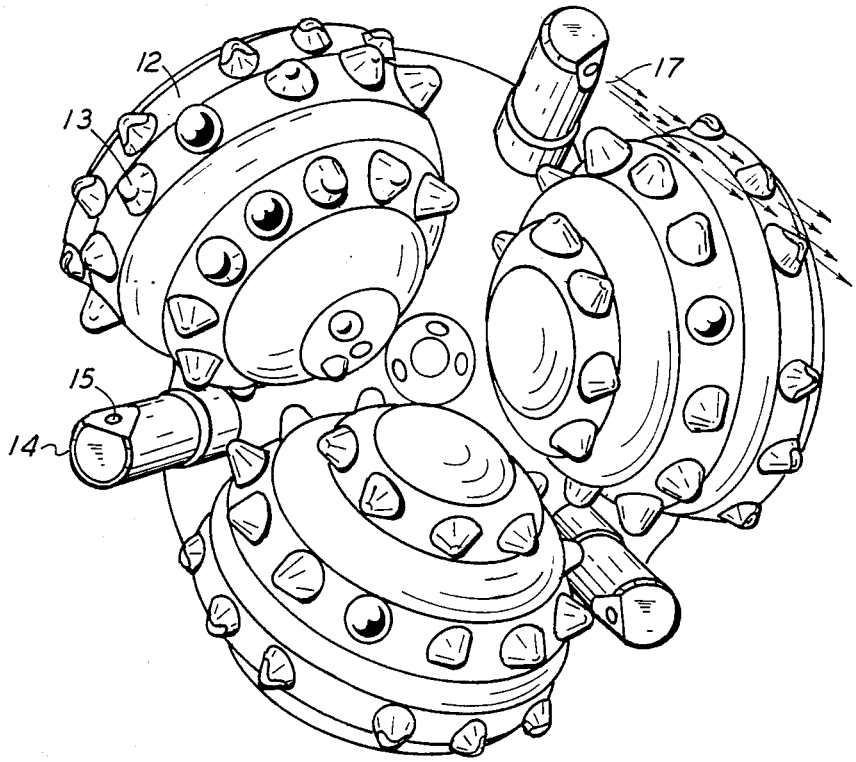
FIG. 2 is a bottom view of a tri-cone bit with three nozzle systems of FIG. 1.

The present invention discloses a directed nozzle retention system for use in a tri-cone rolling cutter drill bit such as that disclosed in FIGS. 1 and 2, comprising a bit body adapted to be detachably secured to a drill string for rotating the bit and to receive drilling fluid under pressure from the drill pipe. In FIG. 1, the drill bit 10 further comprises a lug section 11 having a rolling cutter 12 mounted in cantilever fashion thereon. Cutter 12 comprises a generally frusto-conical cutter body and hard metal cutting elements 13 inserted in bores in the outer surface thereof engageable with the formation at the bottom of the well bore. The cutting elements are preferably formed of a tungsten carbide material having good erosion and abrasion resistant properties and are commonly referred to as inserts. The body of bit 10 has a set of extended fluid jetting nozzles or nozzle members

14 attached thereto with nozzle openings 15 formed therein in communication with a fluid passage 16 in the bit body. A stream of fluid 17 is jetted through passage 16 and nozzle 14 across inserts 13. As shown in FIG. 2, the tri-cone bit has three frusto-conical cutters 12 rotatably mounted on three legs of the bit body and three spray nozzles 14 with each nozzle 14 having its opening 15 directed towards the front of the cutter such that the stream of jetted fluid 17 inpinges the inserts generally tangentially to the cutter immediately prior to the inserts contacting the borehole face.

FIG. 3 is a partial cross-sectional view of the nozzle 14 illustrated in FIGS. 1 and 2. In FIG. 3 the retention and alignment system of the present invention is more clearly disclosed. The nozzle 14 has a generally centrally located bore passaging 18 of varying diameter. Bore passage 18 is wide at its upper portion (i.e., its lower portion as shown in FIG. 3 with the nozzle in inverted position) to coaxially align with fluid passage 16 in the bit body. The bore 18 narrows to a relatively narrow lower end (i.e., upper end as illustrated) exiting at nozzle opening 15. Bore passage 18 where it intersects face 19 of the nozzle is generally perpendicular to face 19. Face 19 makes an angle A with a plane perpendicular to the central longitudinal axis of nozzle 14. Likewise, the upper end of bore passage 18 makes an angle A with the central longitudinal axis C of the nozzle.

An enlarged cylindrical opening or bore 20 is formed in bit body 10 in coaxial alignment with bore passage 16 and extending up from the underside of the bit body. Cylindrical opening 20 is sized for relatively close engagement with nozzle 14 allowing a small amount of clearance therebetween. An annular retention groove 21 is formed in the wall of opening 20 to align with a similar groove 22 formed annularly into the cylindrical wall of nozzle 14. A flat circular snap ring 23 is located conjointly in grooves 21 and 22 to secure nozzle 14 in bore 20 and prevent the nozzle from being blown out of the opening by the drilling fluid under pressure.

Because of the nature of the present invention and more particularly because of the directed orientation of the nozzle bore opening 15, it is important that the nozzle 14 be aligned properly in the body to provide the critical stream of fluid in the proper orientation with respect to the cutters and inserts. Also, it is important that this critical alignment of jet opening 15 be maintained throughout the life of the drill bit. The alignment of the nozzle 14 in bore 20 is better indicated by the partial cross-sectional view of FIG. 4. In FIG. 4, a vertical alignment slot 25 has been machined in a portion of the outer wall of nozzle 14. A generally rectangularly shaped alignment key 26 has been welded in slot 25. A matching alignment groove 27 is formed in the wall of bore 20 at the proper location to provide correct nozzle alignment of opening 15 when key 26 is located therein. The joint action of alignment key 26 in slot 27 and the retention effect of snap ring 23 in grooves 21 and 22 provides retention and alignment of the nozzle in the bit body. Once the proper location of slot 25 and slot 27 have been determined for the particular size and angle bit, the manufacturing process is adapted to form the two slots in the same location for every nozzle and every bit body, thus providing consistent and proper alignment of the nozzle opening with respect to the cutters and inserts for each bit.

The key 26 and slot 27 together thus constitute means for holding the nozzle member 14 in predetermined angular position in the bore 20. Moreover, the portion of the passaging in the nozzle member 14 at the lower end thereof is angled relative to the central longitudinal axis of the nozzle member such that with the nozzle member held in its predetermined angular position in the bore, the passaging directs the drilling fluid under pressure to flow downwardly and in the direction opposite to the direction of rotation of the drill bit. As shown in FIG. 1, the drilling fluid 17 flows in a stream angled relative to the longitudinal axis of the drill bit which is parallel to axis C of the nozzle 14 and generally toward the underside of one of the roller cutters "(i.e., the half of the roller cutter below its axis of rotation)" along a line generally tangent to its cutter body, then flows past the cutter body, and thereafter impinges portions of the formation at the bottom of the well bore closely adjacent to, but spaced apart from all of the points of engagement of the cutting elements of the roller cutter with the bottom of the well bore. Restated in different terminology, the lower portion of the passaging in the nozzle member directs the drilling fluid under pressure to flow downwardly and in the direction opposite to the direction of the drill bit in a stream so angled and positioned relative to one of the roller cutters that as the roller cutter rotates cutting elements thereon enter the stream for being cleaned thereby, and exit the stream prior to engaging the formation. The stream of drilling fluid, after flowing past the cutting elements, impinges the formation at the bottom of the well bore adjacent to, but spaced apart from, the points of engagement of the cutting elements with the formation at the bottom of the well bore. This separate, sequential impingement and cleaning of all of the cutting elements impinged by the stream and the formation just prior to their engagement provides improved cleaning thereof for increased rates of penetration, particularly in drilling formations which become plastically deformable under overbalanced conditions. Overbalance is often encountered in deep hole drilling when the hydrostatic pressure of the column of drilling fluid bearing on the bottom of the well bore exceeds the pore pressure of the formation at the well bore bottom.

FIG. 5 is a view of the nozzle of FIG. 4 rotated 90 degrees, showing the shape and location of slot 25 and the shape and orientation of alignment key 26. FIG. 6 is a top view of the nozzle 14 showing the placement of the key 26 with respect to nozzle opening 15. FIG. 3 is a section taken at line 3—3 of FIG. 6. The base of bore 18 is indicated in phantom at 18'. The material of nozzle 14 is preferably that of the hard, tough metal alloy which is resistant to temperature, corrosion and erosion. In one embodiment of the invention, a tungsten carbide material was used to manufacture nozzles 14 which provided very good wear and corrosion resistance.

As shown in FIGS. 3-5, the nozzle 14 is of generally elongate, cylindrical shape except at the lower portion thereof. The key or projection 26 renders the lower portion of the nozzle non-circular in section. The recess or slot 27 at the end portion of the bore 20 renders it non-circular in section, with the shapes of the non-circular portions of the nozzle and bore corresponding. While the projection is shown and described as being on the nozzle and the recess in the bore, it is contemplated that this projection and recess arrangement could be reversed FIGS. 7 and 8 illustrate an alternate embodiment of nozzle 14 in which a nozzle base 114 is formed of a low-cost alloy such as steel, and a replaceable insert 115 for the abrasion-sensitive exit passage, is secured in a mating bore opening 116 formed in the upper end of nozzle body 114. Nozzle insert 115 has an internal bore 119 coaxially aligned with bore 118 of body 114. An alignment key 126 is welded or brazed in an alignment groove 125 to provide alignment in the bit body. A retention groove 122 is formed in body 114 to provide a snap ring retention area similar to that of the first embodiment. A relieved area 130 is formed along one side of body 114 communicating with groove 122 to allow insertion and removal of snap rings and provide easier replacement of nozzles 114 in the bit bodies upon wear of the nozzles. Similarly, nozzle 14 has a relieved area 30 for installation and removal of snap ring 23 to provide easy removal of nozzle 14 from the bit when the nozzle is ready for replacement.

FIG. 8 is a top view of the nozzle 114 illustrating the alignment pin 126, the upper nozzle insert 115 and the weld areas securing key 126 and insert 115 to the main body 114. Likewise, a pair of alignment marks 131 and 132 are illustrated which have been formed in the nozzle body 114 and nozzle insert 115 during manufacture of these two parts to provide easy alignment of the parts prior to joining by welding or soldering.

Thus, in operation, the nozzle of the first embodiment or the combination nozzle of the second embodiment, is formed having the proper orientation of exit passage for the bit on which it will be used. The alignment key is welded in the machined alignment slot and a snap ring is placed in the snap ring groove on either of the nozzles. A groove in the bit body has been formed at the proper location to receive the alignment key. The nozzle 114 is then pressed into the bore of the body such that the alignment key on the nozzle seats in the alignment groove on the body.

During the insertion of the nozzle in the bore, the snap ring is compressed in order to clear the bore and snap into the retention groove located in the bore. When the nozzle bottoms on the bore, the snap ring will spring outward and provide secure retention of the nozzle on the bit body. The retention key will provide proper alignment of the nozzle and prevent rotation of the nozzle during the life of the nozzle.

When the nozzle has eroded or corroded and needs replacement, a pair of snap ring pliers can be inserted along the relieved surface of the nozzle and the snap ring again compressed to allow easy removal of the nozzle from the bit body. The nozzle 14 would be replaced in total and the compound nozzle 114 could either be replaced in total or the replaceable insert could be replaced and the nozzle main body retained.

On the other hand, if the main body has eroded or corroded, and the insert retains some useful life, the body may be removed from the insert and discarded, and the new body replaced thereon. Thus, the present invention discloses a retention and alignment system that allows quick and easy, as well as accurate placement of the directed nozzles in the bit bodies.

Although specific preferred embodiments of the present invention have been described in the detailed description above, the description is not intended to limit the invention to the particular forms of embodiments disclosed therein, since they are to be recognized as illustrative rather than restrictive, and it will be obvious to those skilled in the art that the invention is not so limited. Thus, the invention is declared to cover all changes and modifications of the specific example of the invention herein disclosed for purposes of illustration which do not constitute departures from the spirit and scope of the invention.

What is claimed is:

1. A rotary drill bit for drilling a well bore, and the bit comprising:

a bit body adapted to be detachably secured to a drill string for rotating the bit, and to receive drilling fluid under pressure from the drill string, the bit body having a plurality of depending legs at its lower end, each leg being spaced from the other legs, and a plurality of nozzle means for exit of the drilling fluid from the bit body; and a plurality of roller cutters, one for each leg, each roller cutter comprising a generally conical cutter body rotatably mounted on the respective leg and a plurality of cutting elements on the cutter body engageable with the bottom of the well bore;

each of said nozzle means comprising a bore extending up from the underside of the bit body, an elongate nozzle member fitted in the bore, and means for detachably securing the nozzle member in the bore, the bore and nozzle member further having means thereon for holding the nozzle member in predetermined angular position in the bore, the nozzle member having passaging therein for flow of drilling fluid therethrough, with the portion of the passaging at the lower end of the nozzle member being angled relative to the longitudinal axis of the nozzle member such that with the nozzle member held in its predetermined angular position in the bore the passaging directs the drilling fluid under pressure to flow downwardly in a stream angled relative to the longitudinal axis of the drill bit and flowing generally toward the underside of one of said roller cutters, constituted by the half of the roller cutter below its axis of rotation, along a line generally tangent to its cutter body, then flowing past the cutter body, and thereafter impinging portions of the bottom of the well bore spaced from the points of engagement of the cutting elements of the roller cutter with the bottom of the well bore.

2. A drill bit as set forth in claim 1 wherein the stream of drilling fluid under pressure flowing from the nozzle member flows generally in the direction opposite to the direction of rotation of the drill bit.

3. A drill bit as set forth in claim 1 wherein the nozzle member along at least a portion of its length is of non-circular sectional shape and the bore along at least a portion thereof is of corresponding non-circular sectional shape, said portions of the nozzle member and the bore constituting said means for holding the nozzle in predetermined angular position in the bore.

4. A rotary drill bit for drilling a well bore, the bit comprising:

a bit body adapted to be detachably secured to a drill string for rotating the bit, and to receive drilling fluid under pressure from the drill string, the bit body having a plurality of depending legs at its lower end, each leg being spaced from the other legs, and a plurality of nozzle means for exit of the drilling fluid from the bit body; and a plurality of roller cutters, one for each leg, each roller cutter comprising a generally conical cutter body rotatably mounted on the respective leg and a plurality of cutting elements on the cutter body engageable with the bottom of the well bore;

each of said nozzle means comprising a bore extending up from the underside of the bit body, an elongate nozzle member fitted in the bore, and means for detachably securing the nozzle member in the bore, the bore and nozzle member further having means thereon for holding the nozzle member in predetermined angular position in the bore, the nozzle member having passaging therein for flow of drilling fluid therethrough, with the portion of the passaging at the lower end of the nozzle member being angled relative to the longitudinal axis of the nozzle member such that with the nozzle member held in its predetermined angular position in the bore the passaging directs the drilling fluid under pressure to flow downwardly in a stream angled relative to the longitudinal axis of the drill bit and flowing generally toward the underside of one of the roller cutters, constituted by the half of the roller cutter below its axis of rotation, with the stream being so angled and positioned relative to said roller cutter that as said roller cutter rotates cutting elements thereon enter the stream for being cleaned thereby, and exit the stream prior to engaging the formation, with the stream after flowing past the cutting elements impinging the formation at the bottom of the well bore adjacent to, but spaced apart from, the points of engagement of the cutting elements with the bottom of the well bore.

5. A drill bit as set forth in claim 4 wherein the stream of drilling fluid under pressure flowing from the nozzle member flows generally in the direction opposite to the direction of rotation of the drill bit.

6. A drill bit as set forth in claim 4 wherein the nozzle member along at least a portion of its length is of non-circular sectional shape and the bore along at least a portion thereof is of corresponding non-circular sectional shape, said portions of the nozzle member and the bore constituting said means for holding the nozzle in predetermined angular position in the bore.

* * * * *